US009186001B2

(12) United States Patent
Popkin

(10) Patent No.: US 9,186,001 B2
(45) Date of Patent: Nov. 17, 2015

(54) OFFSET HANGER FOR MINIMIZING SPACE BETWEEN FRAME AND WALL

(71) Applicant: Jeffrey Popkin, Weston, FL (US)

(72) Inventor: Jeffrey Popkin, Weston, FL (US)

( * ) Notice: Subject to any disclaimer, the term of this patent is extended or adjusted under 35 U.S.C. 154(b) by 0 days.

(21) Appl. No.: 14/250,646

(22) Filed: Apr. 11, 2014

(65) Prior Publication Data

US 2014/0326848 A1 Nov. 6, 2014

Related U.S. Application Data

(60) Provisional application No. 61/810,861, filed on Apr. 11, 2013.

(51) Int. Cl.

| | |
|---|---|
| ***F16M 13/00*** | (2006.01) |
| ***A47G 1/16*** | (2006.01) |
| ***A47G 1/22*** | (2006.01) |

(52) U.S. Cl.

CPC ..... *A47G 1/162* (2013.01); *A47G 1/1613* (2013.01); *A47G 1/22* (2013.01)

(58) Field of Classification Search

CPC ..... A47G 1/22; A47G 1/162; A47G 1/1613
USPC ..... 248/475.1, 476, 488, 489, 495, 547
See application file for complete search history.

(56) References Cited

U.S. PATENT DOCUMENTS

| | | | | |
|---|---|---|---|---|
| 468,637 | A | 2/1892 | Billings | |
| 769,695 | A | 9/1904 | Gurr | |
| 821,159 | A | 5/1906 | Feldman, Jr. | |
| 1,147,863 | A | 7/1915 | Hickerson | |
| 1,908,200 | A * | 5/1933 | Webster | 248/495 |
| 2,299,443 | A * | 10/1942 | Walmsley | 248/497 |
| 2,820,311 | A | 1/1958 | Hamlin | |
| 3,556,459 | A | 1/1971 | Summerville, Jr. | |
| 3,622,116 | A * | 11/1971 | Fellows | 248/467 |
| 4,458,873 | A | 7/1984 | Sutherland | |
| 4,591,125 | A * | 5/1986 | Bellehumeur | 248/476 |
| 4,689,906 | A | 9/1987 | Sherman | |
| 5,314,159 | A * | 5/1994 | Szarata | 248/476 |
| 5,425,524 | A * | 6/1995 | Messina, Jr. | 248/475.1 |
| 5,749,558 | A | 5/1998 | Wallo | |
| 7,201,357 | B2 | 4/2007 | Price et al. | |
| 7,677,521 | B2 | 3/2010 | Price | |
| 8,398,048 | B2 | 3/2013 | Popkin et al. | |
| 2009/0224116 | A1 * | 9/2009 | Gallien | 248/205.3 |

* cited by examiner

*Primary Examiner* — Gwendolyn Baxter
(74) *Attorney, Agent, or Firm* — Myron Greenspan; Lackenbach Siegel LLP

(57) ABSTRACT

A picture frame hanger includes a member stamped of thin sheet having a thickness on the order of 0.05" and includes a lower flat depending portion arranged in a first vertical plane. At least one connecting portion or tab is provided that is horizontally offset from the depending portion and arranged in a second vertical plane parallel to the first plane. An integral bridging portion is arranged in a horizontal plane or normal to the first and second planes spaced a distance less than a depth of the upper rail. The connecting portion attaches the hanger to the upper rail rear surface. The depending portion is offset by the bridging portion to position the depending portion internally of the frame cavity spaced from the wall. The frame can be supported on a wall or surface while being spaced from the wall by only the thickness of the connecting portions.

19 Claims, 5 Drawing Sheets

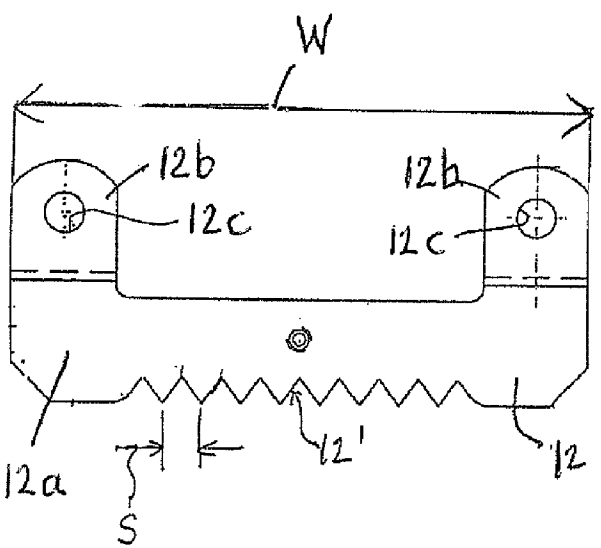
FIG. 1
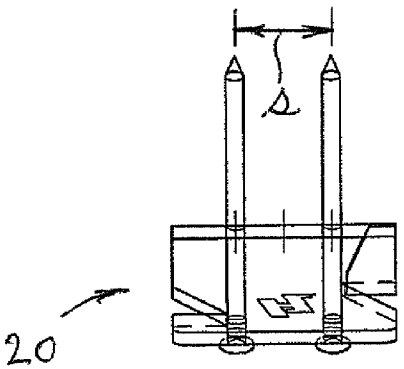
FIG. 3
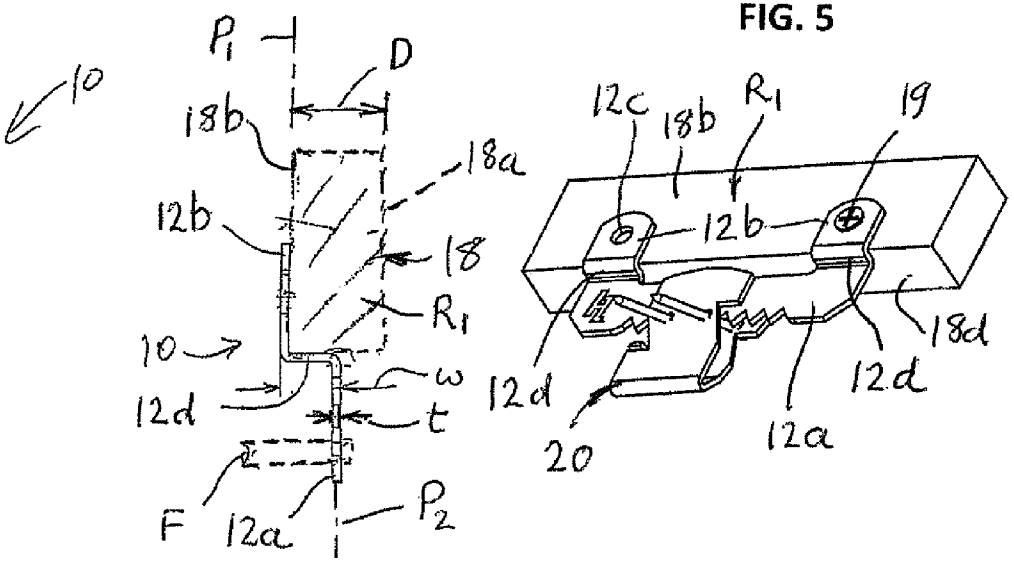
FIG. 5
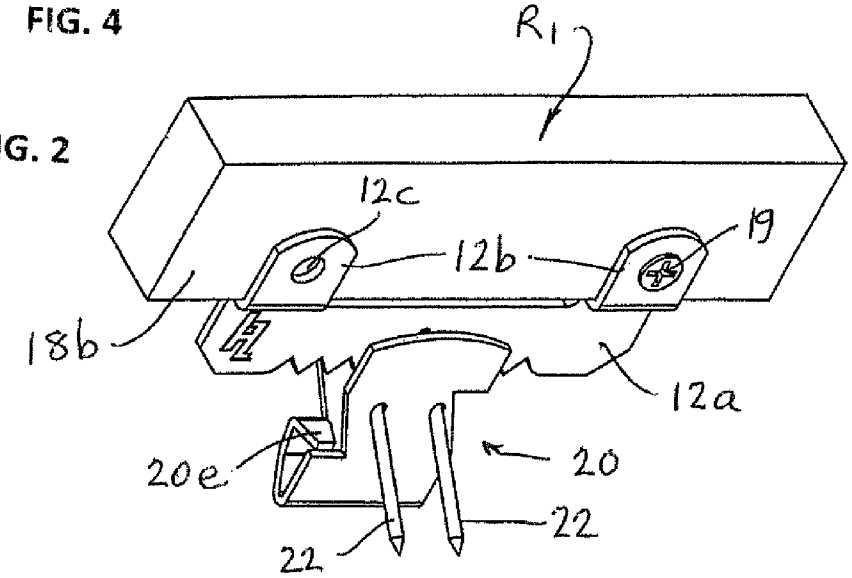
FIG. 4
FIG. 2

26
36'
36

26
36

36

36'
34
36
26

36
28'
28
R4
26a
26b 36
26

OFFSET HANGER FOR MINIMIZING SPACE BETWEEN FRAME AND WALL

BACKGROUND OF THE INVENTION

1. Field of the Invention

The invention generally relates to methods and devices for hanging picture frames and the like on walls, and more specifically, to an offset hanger for minimizing the space between the picture frame and a wall on which it is mounted.

2. Description of the Related Art

Numerous designs of hangers have been proposed for hanging picture frames on a wall. However, none of these appears to be of a construction in which most of the hanger is recessed within the frame and the only portion of hanger that projects behind the frame is a thin sheet of metal from which the hanger is formed.

In U.S. Pat. No. 1,147,863 issued in 1915 to Hickerson et al. for a suspending device. The patent discusses a main body 6 formed with a hole 7 for attachment to the rear surface of a picture frame. However, as shown in FIGS. 2-7 the rings 9 and 18 in FIGS. 2-5 and the eyelet portion 23 shown in FIGS. 5 and 7 project rearwardly behind the rear surface of the frame. Therefore, there is no suggestion of placing or positioning the actual attachment or connector portions that interface with the wall inwardly of the rear surface of the frame and within a cavity, space represented by the thickness of the frame.

An earlier U.S. Pat. No. 821,159 issued in 1906 to Feldmann for a hanger for picture frames shows the hanger attached within the picture frame cavity but a prong 3 projects behind the frame. (See FIGS. 2 and 3).

U.S. Pat. No. 2,820,311 is for a picture frame securing bracket issued to Hamlin that appears to be attached below the stretcher frame 13 (FIG. 2) with the wire 15 extending from the bottom of the frame as shown in FIG. 1. Therefore, while the flat portion 8 is the only one that extends behind the frame 13, the bracket is attached to a picture frame 5 and not the frame 13 on which the canvass is stretched. Also, it is not clear how the picture using the Hamlin device would actually hang on the wall considering that it extends from the bottom of the frame.

U.S. Pat. No. 3,556,459 discloses a frame mounting bracket issued to Summerville, Jr. that is partially received within a cavity of the frame 20 (FIGS. 2-6) but extends rearwardly of the back surface of the frame as best shown in FIGS. 2 and 6.

In Sutherland's U.S. Pat. No. 4,458,873 for a picture frame hanger clip the actual hook also appears to project to the back of the frame beyond the rear surface as suggested in FIG. 5. Also, the hardware is not attached to the frame itself but supported by the rear panel or backing 14.

A display frame for mounting vertical surface is disclosed in U.S. Pat. No. 4,689,906 to Sherman. However, the mounting hardware appears to be designed to interface with a specific frame configuration, a section of which is shown in FIG. 4. Also, as shown in FIGS. 2-4, the lower portion 37 extends significantly to the rear of the picture frame 12.

U.S. Pat. No. 5,749,558 to Wallo is for a wall mounted picture hanger. The picture hanger appears somewhat complicated in construction and in normal use with the variety of picture frames appears to project significantly behind the frames (FIGS. 3, 4 and 5). In FIG. 2 the picture hanger appears to be recessed within the picture frame cavity and shows the hanger attached to the wall "supporting a wooden picture frame" (Col. 2, lines 54-56). However, it is not clear whether the actual picture or canvass or mirror is mounted within the cavity of the frame 64. In FIG. 2 no portion of the picture hanger appears to be connected or fastened to the rear surface of the picture frame and, instead, the entire hanger is attached to the wall and the picture frame is simply supported by the device.

SUMMARY OF THE INVENTION

Accordingly, it is an object of the invention to provide a hanger that does not possess the disadvantages inherent in prior art picture hangers.

It is another object of the invention to provide a hanger that is simple in construction and economical to manufacture.

It is still another object of the invention to provide a hanger that generally has a Z-shaped cross-section, at least along portions thereof that allows the hanger to cooperate with a wall fastener and be offset internally within the frame cavity to minimize the space between the frame and the wall when normally hung on the wall.

It is yet another object of the invention to provide a hanger of the type under discussion that can assume different embodiments or configurations to accommodate different fasteners attached to a wall.

It is a further object of the invention to provide a hanger as in the last object in which the operative portion of the hanger that faces the wall is in the form of or includes a saw tooth edge.

It still a further object of the invention to provide a hanger as in the previous objects that can be attached to the lateral rails of a picture frame and includes spaced rings to be used in conjunction with braided or other hanging wires or cables that are use to support the frame on a wall fastener.

It is yet a further object of the invention to provide a hanging adapter or accessory that can be fastened to a wall in any suitable or conventional manner and that can cooperate and engage with the offset or recessed portion of the hanger.

It is an additional object of the invention to provide a hanger of the type under discussion that is simple and convenient to use to hang or mount a frame for a canvass or photograph.

It is still an additional object of the invention to provide a hanger that is reliable and can securely support a picture frame while minimizing the spacing between the picture frame and a wall on which it is mounted.

In order to achieve the above objects, as well as others that will become apparent hereinafter, an offset hanger attaches a picture frame to a wall. The picture frame has vertically spaced horizontal upper and lower rails and spaced lateral rails all having a predetermined depth, and front surfaces to which a picture or canvass is attached and rear surfaces facing a wall on which the frame is to be mounted. The hanger comprising a member formed of sheet material having a width less than the spacing between the lateral rails and includes a generally lower flat depending portion arranged in a first vertical plane. At least one connecting portion or tab is horizontally offset from said depending portion and arranged in a second vertical plane parallel to said first plane. An integral bridging portion is generally arranged in a horizontal plane orthogonal to said first and second planes and has a depth dimension less than the depth of the upper rail between its front and rear surfaces. The connecting portion forms means for attaching the hanger to the upper rail rear surface. Said depending portion is offset by said bridging portion to position or recess said depending portion internally of the space or region defined by the rails of the frame and offset or spaced from a wall or supporting surface when normally hung on the wall. Said depending portion forms means for cooperating with a fastener that is fixed to the wall or supporting surface. The frame can, therefore, be supported on a wall or surface while being spaced from the wall by only the thickness of said connecting portion(s).

A hanger accessory may be used in conjunction with a saw tooth hanger in accordance with the invention to stabilize the frame from undesired rotations by incorporating at least two nails or fasteners that are spaced a distance corresponding to the period or distances between the teeth or notches on the saw tooth or multiples thereof. In the preferred embodiment the teeth or notches are triangular.

BRIEF DESCRIPTION OF THE DRAWINGS

Those skilled in the art will also appreciate the improvements and advantages that derive from the present invention upon reading the following detailed description in conjunction with the Figures in which:

FIG. 1 is a front elevational view of an offset hanger in accordance with the present invention provided with a lower saw tooth edge for interfacing with or being positioned on a wall fastener;

FIG. 2 is an upper perspective view of the hanger shown in FIG. 1, partially secured to an upper picture frame rail and also illustrating a hanger accessory that can be secured to a wall or other hanging surface and engaged with the hanger;

FIG. 3 a top plan view of the accessory shown in FIG. 2;

FIG. 4 is a right side elevational view of the hanger, as viewed along direction 4-4 in FIG. 1, showing in outline the upper frame rail of FIG. 2 to which the hanger is secured;

FIG. 5 is similar to FIG. 2 but shows a lower perspective view;

DETAILED DESCRIPTION OF THE PREFERRED EMBODIMENT

Figure 10:
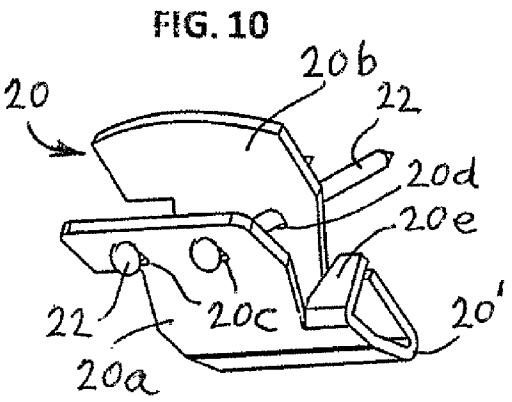
FIG. 10 is an upper perspective view of the hanger accessory shown in FIGS. 2, 3 and 5-9.
Figure 11:
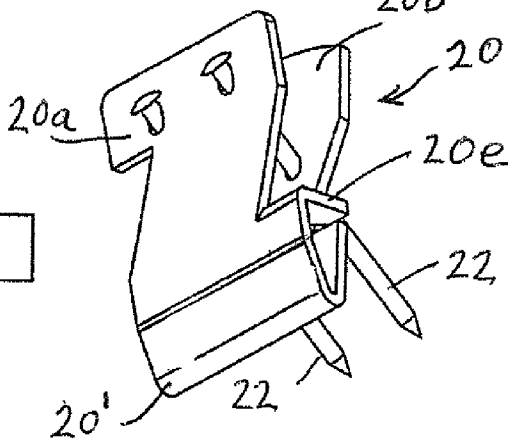
FIG. 11 is similar to FIG. 10 but taken from a lower perspective.
Figure 8:
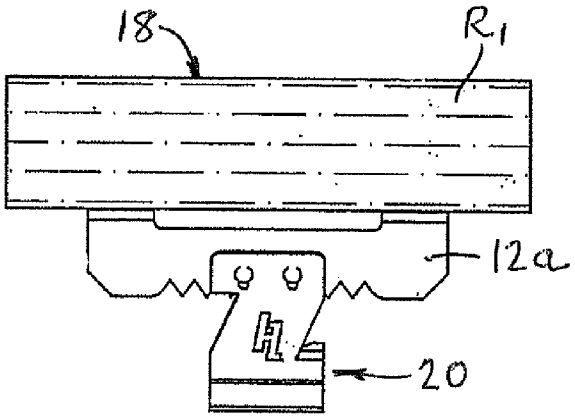
FIG. 8 is a fragmented rear elevational view of a portion of upper frame rail and the offset hanger of FIGS. 1, 2, 4 and 5 attached thereto and the interaction with the accessory shown in FIG. 3.
Figure 9:
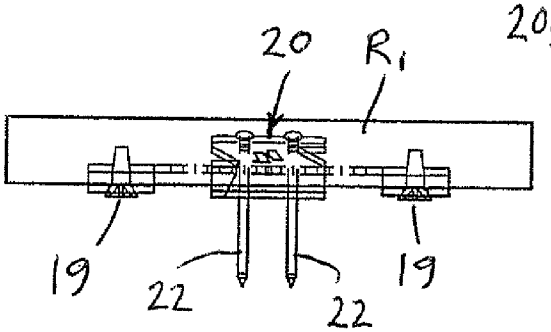
FIG. 9 is a fragmented top plan view of an upper frame rail showing the manner in which the hanger is secured to the frame as well as the general position and orientation of the hanger accessory.

Referring now specifically to the Figures, in which identical or similar parts are designated by the same reference numeral throughout, and first referring to FIGS. 1 and 2, a preferred embodiment in accordance with the present invention is generally designated by the reference numeral 10.

Figure 6:
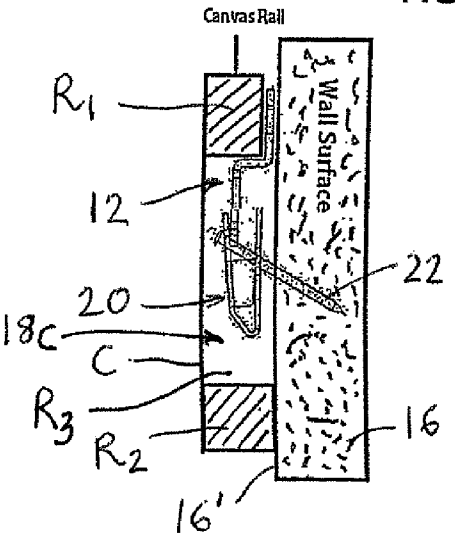
FIG. 6 is a diagrammatic cross-sectional view of a frame to be mounted and the general positions and orientations of the hanger and the hanger accessory in accordance with the present invention when mounted on a wall surface.
Figure 7:
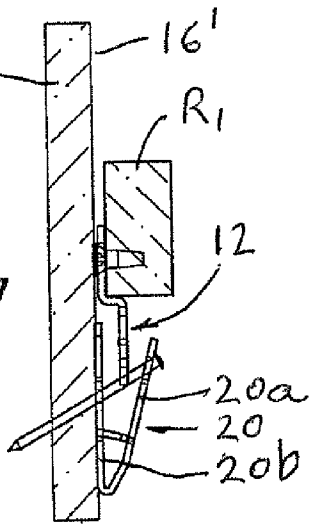
FIG. 7 is similar to FIG. 6, as viewed from the opposite side of the hanger and accessory also showing the fastener for securing the hanger to the frame.
Figure 12:
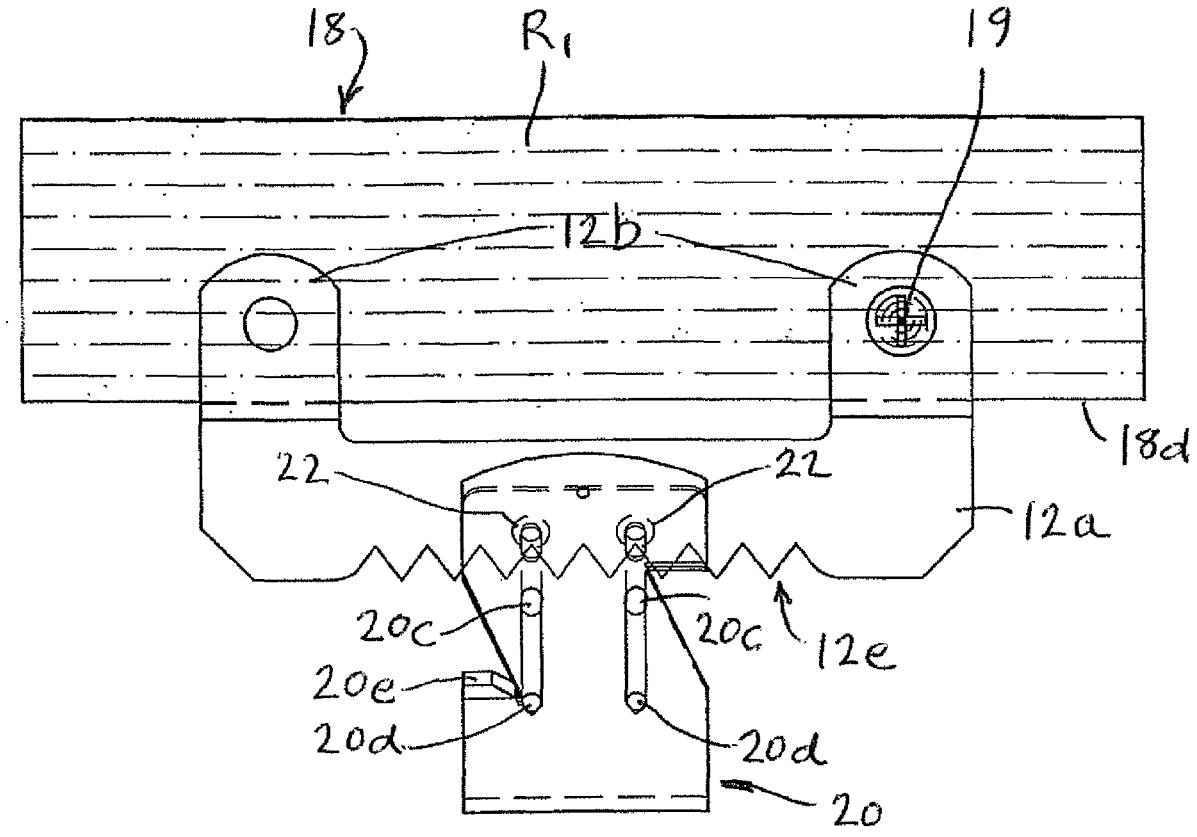
FIG. 12 is an enlarged front elevational view similar to FIG. 8.
Figure 13:
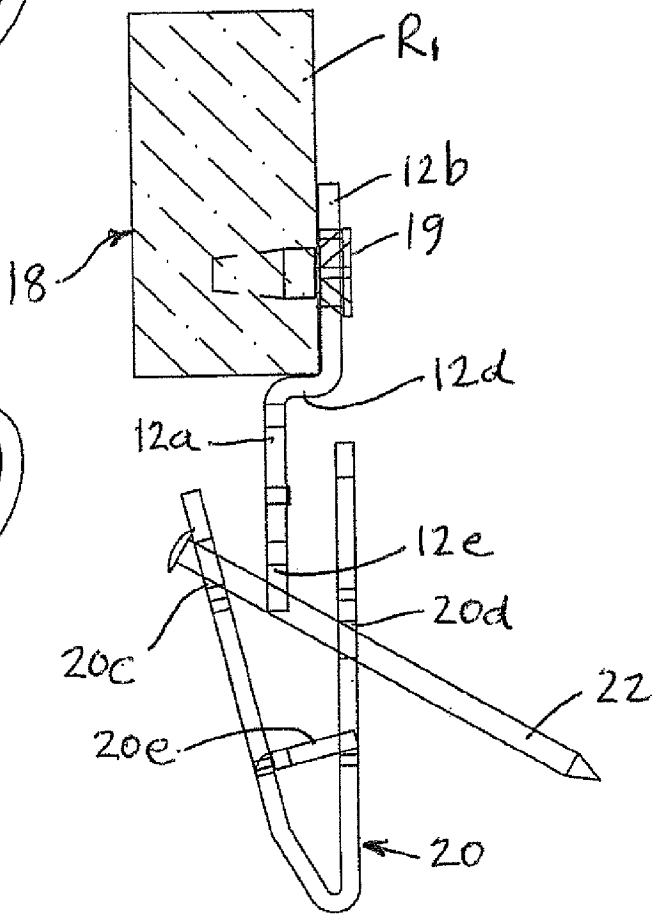
FIG. 13 is similar to FIGS. 6 and 7 but shows details of the hanger system in accordance with the invention.
Figure 14:
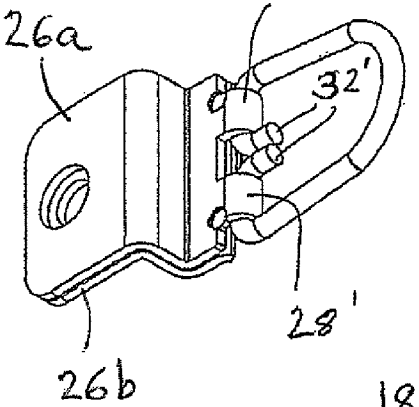
FIG. 14 is a perspective view of a D-ring used in conjunction with an offset hanger bracket in accordance with another embodiment the invention.
Figure 15:
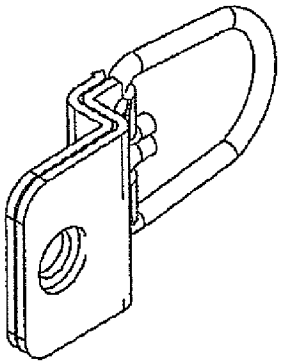
FIG. 15 is similar to FIG. 14 but is an upper perspective view.
Figure 16:
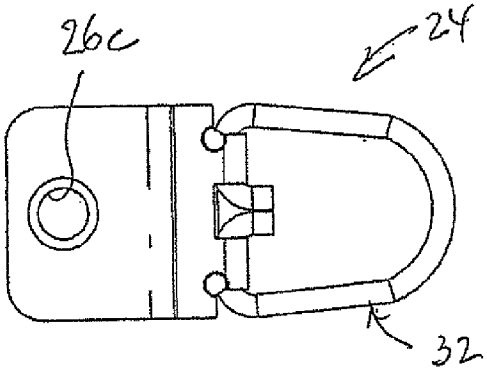
FIG. 16 is a front elevational view of the hanger shown in FIGS. 14 and 15.
Figure 17:
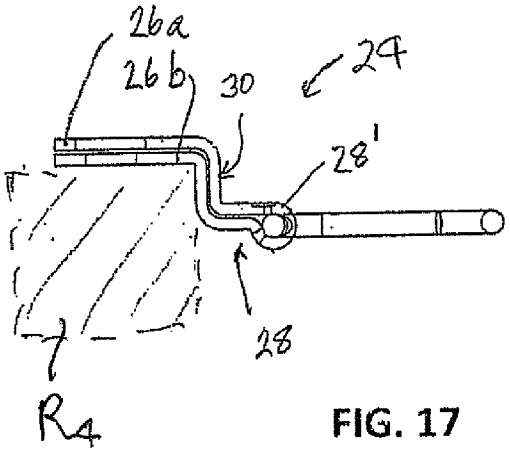
FIG. 17 is a top plan view of the hanger shown in FIGS. 14-16.
Figures 18, 19, 20, 21, 22, 23:
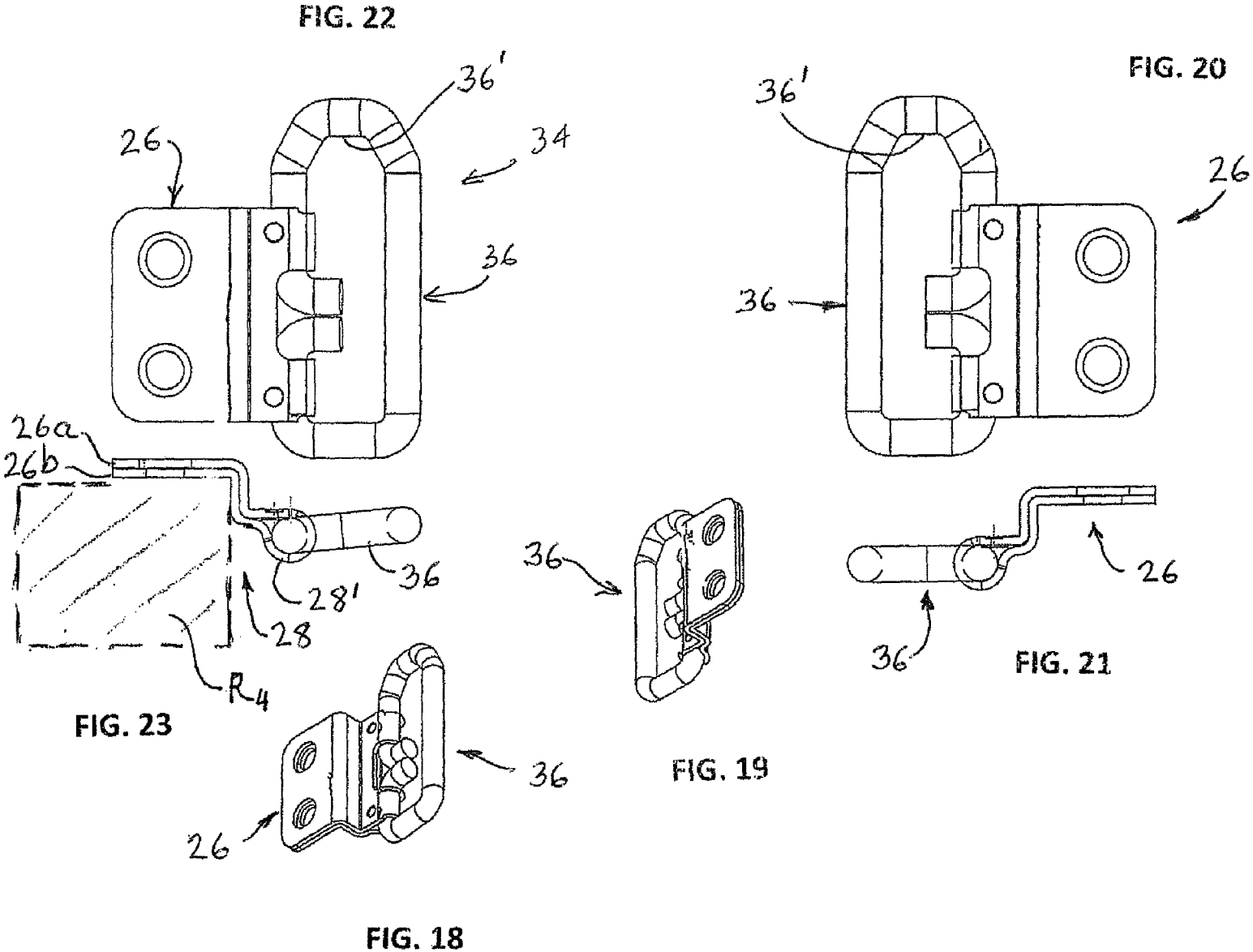
FIG. 18 is similar to FIG. 14 but shows a modified version of the D-ring in accordance with still another embodiment of the invention.
FIG. 19 is similar to FIG. 18 but showing the other or opposite side of the offset hanger and ring.
FIG. 20 is a front elevational view of the modified hanger shown in FIGS. 18 and 19.
FIG. 21 is a top plan view of the modified hanger shown in FIGS. 18-20 and shows in phantom outline the manner in which the hanger is mounted on a lateral or side rail of a frame.
FIG. 22 is similar to FIG. 20 but shows the opposing side of the hanger.
FIG. 23 is a top plan view of the hanger shown in FIG. 22.

The hanger 10 is specially adapted for use with a picture frame 18 (FIG. 6) having spaced horizontal upper and lower rails $R_1$, $R_2$ and spaced lateral rails $R_3$, $R_4$. The rails $R_1$-$R_4$ have a predetermined depth or thickness D (FIG. 4) and front surfaces 18*a* to which a picture or canvas C (FIG. 6) is attached and rear surfaces 18*b* that face a wall on which the frames to be mounted. The canvas C is suitably mounted in any conventional way on the frame 18. Since the rails $R_1$-$R_4$ have a predetermined depth D or thickness, the frame 18 defines an internal space, volume or cavity 18*c* one side of which facing the canvas C is closed or covered by the painting, photo or canvas and the opposing side facing the direction of the rear surfaces 18*b* is open. The horizontal distance within the open portion within the space or cavity 18*c* of the frame defines a predetermined width W that will, clearly, be a function of the size of the frame.

One embodiment of the present invention includes a member 10 formed of a sheet metal that has a predetermined width w less than the spacing or width W between the lateral rails $R_3$, $R_4$. The hanger 10 includes a generally lower flat depending portion 12*a* formed of a generally thin sheet material having a predetermined thickness t arranged in a first plane $P_1$ (FIG. 4).

Connecting portions or tabs 12*b* are offset from the depending portion 18*a* and arranged in a second plane $P_2$ (FIG. 2) that is parallel to plane $P_1$. A bridging portion 12*d* is integrally formed with and joins depending and connecting portions 12*a*, 12*b*.

The first and second planes P1 and P2 are spaced a distance d less than the depth D of the upper rail $R_1$ between the front and rear surfaces 18*a*, 18*b*. The connecting or upper portions 12*b*, as viewed in Figures, form means for attaching a hanger 10 to the upper rear surface 18*b*, the depending portion 12*a* being offset by the bridging portion 12*d* to position the depending portion recessed internally of the space 18*c* formed by the rails of the frame and to be offset from the wall 16 supporting surface 16' (FIG. 6) in a normal hanging position of the frame. The depending portion 12*a* forms means for cooperating with a fastener F (FIG. 4) attached to a wall or a supporting surface. In this manner, the frame can be supported on a wall or a surface while being spaced therefrom by only the predetermined thickness t of the connecting portions or tabs 12*b*.

The member 10 may be stamped from sheet metal to from the shown configuration. For example, low carbon steel (SAE-1015) sheet stock may be used that is 18 gauge with t=0.05".

In accordance with a present embodiment, in order to facilitate mounting and to enhance stability, two connecting portions 12*b* are provided at the free or opposite ends of the dependent portion 12*a*. It will be evident to those skilled in the art that a different number of connecting tabs 12*b* can be used and arranged at different positions than shown, for example, in FIG. 1. Thus, three connecting portions 12*b* may be provided, for example, that are equally spaced from each other so that an additional portion 12*b* can be formed at the center equally spaced from connecting portions shown. It is also possible, for example, have a single solid connecting portion extending between the free ends of the member 12 with additional holes 12*c* formed therein to provide added strength and reliability to the item. When connecting portion 12*b* is formed as one continuous strip of metal instead of spaced connecting tabs, as shown in FIG. 1, the unit will have a substantially uniform cross-section along the entire width direction of the hanger generally in the shape of a Z-shaped profile. When tabs are used as shown in FIG. 1, the Z-shaped profiles would, clearly, only be manifested at the locations of the connecting portions or tabs 12*b*. The tabs in the presently preferred embodiment include holes 12*c* used to attach the hanger to the back of the frame 18 with suitable fastener such as screws 19 (FIGS. 2 and 5).

By offsetting the planes $P_1$ and $P_2$ and imparting a Z-shape to the hanger, the connecting portions 12*b* can be secured to the outside surface 18*b* of the frame with the depending portion 12*a* projecting inwardly into the space, volume or cavity 18*c* (FIG. 6) with the bridging portion 12*d* essentially abutting against the lower surface 18*d* of the upper rail $R_1$ shown, for example, in FIGS. 2, 5 and 6-9. By providing the offset as shown the lower depending portion 12*a* becomes recessed within the body of the frame without any part thereof projecting outwardly of the cavity 18*c* in the direction of the wall or other mounting surface 16' other than the very thin connecting portions 12*b*.

The depending portion 12*a* is shown to be formed at its lower edge with a saw tooth configuration 12*e* to facilitate attachment to a wall or supporting surface. In this way, the frame 18 can be supported on a wall surface while being spaced from the wall surface only by the very small predetermined thickness t of the connecting portions 12*b*.

Another feature of the invention is the provision of a hanger accessory or hook 20 that can optionally be used with the hanger 10. The accessory is formed as a generally V-shaped sheet of material shown in FIGS. 2 and 5-10 to create two angularly offset panels 20*a*, 20*b*. The accessory forms a V-shaped profile and is provided with spaced holes 20*c* in panel 20*a* and spaced holes 20*d* in panel 20*b* for receiving nails or other fasteners 22 as shown. The spacing between the holes is selected to correspond to the period or frequency S (FIG. 1) of the saw teeth 12*e*. In this way, the spacing between the two nails 22 used with the accessory are spaced to be readily and securely received within the notches or teeth of the saw tooth. Clearly, the accessory can be made larger or smaller. However, the separation should be equal to the cycle or period of the teeth 12*e* or a multiple thereof to ensure that the nails are fully received within the triangular notches of the saw tooth.

In use, the hangers are oriented to abut the connecting portions 12*b* against the rear surface 18*b* of the upper rail $R_1$ and the bridging portion(s) 12*d* in abutment with the lower surface 18*c* of the same rail $R_1$ as shown in FIG. 2. Suitable fasteners, such as screws 19 are used to attach the hanger 10 to the back of the rail $R_1$. This, as indicated, positions the depending portion saw tooth edge 12*e* interiorly or recessed within the frame 18 within the volume, space or cavity 18*c*. Once secured in place, the saw tooth lower edge 12*e* can be rested on a nail or a fastener F projecting from a wall. When placed on a single nail or fastener the user needs to engage the nail with a triangular saw tooth notch that is generally above the center of gravity of the frame to ensure that the frame remains hanging vertically. This is less critical when two nails are used with the accessory 20 since the frame 18 is provided with additional support and resistance against rotation.

When using the accessory 20, after the hanger 10 has been attached to the frame, the nails 22 are driven through the holes 20*c*, 20*d* of the accessory so that the nails are generally horizontally aligned. Now, as suggested, the saw tooth depending portion 12*a* can be placed on the nails to fully register with two notches. However, clearly, the hanger 10 may be used with or without the accessory.

Preferably, the hanger accessory is provided with an inwardly turned tab or stop 20*e* that prevents or minimizes the ability of the vertical plates or arms of the accessory from getting to close to each other and, therefore, the tabs 20*e* serve as spacers that maintain the accessory open for access by a hanging member 10. This facilitates the insertion of the depending saw tooth edge portion 12*e* into the space between the arms or plates 20*a*, 20*b*.

Referring to FIGS. 14-17 an alternate embodiment 24 of the invention shown in which the hangers are intended to be attached to the lateral rails $R_3$, $R_4$ of the frame 18 but provided with similar indents or offsets to ensure that the ring 32, pivotedly mounted on hinge portions 28' is also offset and positioned internally within the space or cavity 18*c* away from the wall. The recessed portions of all of hangers in accordance with the present invention, therefore, are maintained within the cavity or space 18*c* defined by the frame and the only part of the hanger that projects rearwardly behind the frame in the direction of the rear surfaces are the connecting portions 2*b*. In this embodiment 24 the hinge member 28' supports the ring 32. By providing the hangers and rings 32 on opposite lateral rails of the frame a metal cable, solid wire or other string can be secured to the two spaced rings that spans between the lateral rails to also enable the string or cable to be placed upon a fastener projecting from a wall. With these hangers the frame can be adjusted to be horizontal by simply shifting the frame to one lateral side or the other on the wall fastener until the supporting fastener is aligned with the center of gravity of the frame.

FIGS. 18-23 are similar to FIGS. 13-17 but show a modified version 34 of the hanger in which the shape of the ring 36 is more vertically elongated with a somewhat narrowed upper portion 36'. These hangers can also be mounted on the lateral rails of the frame but hang on a nail or fastener projection from a wall without the use of a cable or rope.

The hanger accessory 20 would, therefore, only and typically be used with the saw tooth hanger 10.

It will be appreciated that the hanger design of the present invention, irrespective of the specific format or method of use, places the major portions of the hangers within the space or cavity of the frame so that they do not project rearwardly. In each case, the frames can be hung practically flat against the wall or hanging surface, limited only by the thickness t of the connection portions 12*b* that are secured to the back surface 18*b* of the frame.

The hangers can be readily formed from sheet metal, as shown, such as by die cutting and bending or stamping. The hangers may also be molded from a plastic material having the strength and thickness needed to support the weight of the frame to be hung. The frames, therefore, can typically be spaced from the wall when hang, a very small distance in the order of magnitude of approximately 0.05".

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

The invention claimed is:

1. A hanger for attaching a picture frame having spaced horizontal upper and lower rails and spaced lateral rails having a predetermined depth, and said rails having front surfaces visible when the frame is mounted on a wall or supporting surface and rear surfaces facing the wall or supporting surface on which the frame is to be mounted, said hanger comprising a first connecting portion projecting in a predetermined direction and formed of thin sheet material having a predetermined thickness and arranged in a first plane and having an attachment surface facing a transverse direction generally normal to said predetermined direction adapted to abut against one of said rear surfaces and a second connecting portion projecting in a direction opposite to said predetermined direction and the second connecting portion offset from said first connecting portion in said transverse direction and arranged in a second plane substantially parallel to said first plane and connected to said first connecting portion by a bridging portion, said first and second planes being spaced a distance less than said predetermined depth of said rails between said front and rear surfaces, said first connecting portion including first means for attaching the hanger to abut said attachment surface to a rail rear surface, said second connecting portion being offset by said bridging portion to position said second connecting portion internally of a space formed by the rails of the frame between said front and rear surfaces and offset or spaced from the wall or supporting surface in a normal hanging position of the frame, said second connecting portion including second means for cooperating with a fastener on the wall or supporting surface, whereby the frame can be supported on the wall or supporting surface while being spaced from the wall or supporting surface substantially by said predetermined thickness of said first connecting portion.

2. A hanger as defined in claim 1, wherein the hanger is to be secured to the upper rail of the frame and said first connecting portion comprises at least one upwardly projecting portion.

3. A hanger as defined in claim 2, wherein said first means for attaching said first connecting portion to the upper rail comprises at least one hole formed in said first connecting portion for receiving a fastener for penetrating the upper rail.

4. A hanger as defined in claim 2, wherein said first connecting portion comprises two spaced tabs.

5. A hanger as defined in claim 4, wherein said two tabs are spaced to position same at lateral ends of said second connecting portion.

6. A hanger as defined in claim 2, wherein said second connecting portion is provided with a lower edge formed with at least one recess for receiving the fastener on the wall for preventing lateral displacements relative to the fastener.

7. A hanger as defined in claim 6, wherein the lower edge is formed with a zigzag shape to provide a plurality of adjacent recesses.

8. A hanger as defined in claim 2, wherein said first connecting portion has a width less than the spacing between said lateral rails.

9. A hanger as defined in claim 1, wherein said bridging portion is dimensioned to position said second connecting portion substantially midway within said space between said first and second planes.

10. A hanger as defined in claim 1, wherein said first and second connection portions and said bridging portion are integrally formed.

11. A hanger for attaching a picture frame having spaced horizontal upper and lower rails and spaced lateral rails having a predetermined depth, and said rails having front surfaces visible when the frame is mounted on a wall or supporting surface and rear surfaces facing the wall or supporting surface on which the frame is to be mounted, said hanger comprising a first connecting portion projecting in a predetermined direction and formed of thin sheet material having a predetermined thickness and arranged in a first plane and a second connecting portion projecting in a direction opposite to said predetermined direction and said second connecting portion offset from said first connecting portion and arranged in a second plane substantially parallel to said first plane and connected to said first connecting portion by a bridging portion, said first and second planes being spaced a distance less than said predetermined depth of said rails between said front and rear surfaces, said first connecting portion including first means for attaching the hanger to a rail rear surface, said second connecting portion being offset by said bridging portion to position said second connecting portion internally of a space formed by the rails of the frame between said front and rear surfaces and offset or spaced from the wall or supporting surface in a normal hanging position of the frame, said second connecting portion including second means for cooperating with a fastener on the wall or supporting surface with said second connecting portion arranged between said first and second planes with the exception of said first connecting portion which is secured to a rear surface of one of said rails.

12. A hanger for attaching a picture frame having spaced horizontal upper and lower rails and spaced lateral rails having a predetermined depth in combination with a fastener securable to a wall or supporting surface, and said rails having front surfaces visible when the frame is mounted on the wall and rear surfaces facing the wall on which the frame is to be mounted, said hanger comprising a first connecting portion projecting in a predetermined direction and formed of thin sheet material having a predetermined thickness and arranged in a first plane and a second connecting portion projecting in a direction opposite to said predetermined direction and said second connecting portion being offset from said first connecting portion and arranged in a second plane substantially parallel to said first plane and connected to said first connecting portion by a bridging portion, said first and second planes being spaced a distance less than said predetermined depth of said rails between said front and rear surfaces, said first connecting portion including first means for attaching the hanger to the rail rear surface, said second connecting portion being offset by said bridging portion to position said second connecting portion internally of said space formed by the rails of the frame between said front and rear surfaces and offset or spaced from the wall or supporting surface in a normal hanging position of the frame, said second connecting portion including second means for cooperating with said fastener on the wall or supporting surface, said fastener being dimensioned to be receivable within said space formed by said rails whereby the frame can be supported on the wall or supporting surface while being spaced from the wall or supporting surface substantially by said predetermined thickness of said first connecting portion, wherein said fastener is made of generally flat material and formed to create a substantially uniform v-shaped cross-section to define front and rear portions when mounted on the wall, said rear portion substantially having the thickness of said first connecting portion, said front portion extending into said space formed by said frame, said fastener being attachable to the wall to position said rear portion in contact with a wall or supporting surface on which the frame is to be mounted to allow said second connecting portion to be supported by said fastener while said second connecting portion of the hanger and front portion or said fastener remain within said space.

13. A hanger for attaching a picture frame having spaced horizontal upper and lower rails and spaced lateral rails having a predetermined depth, and said rails having front surfaces visible when the frame is mounted on a wall or supporting surface and rear surfaces facing the wall or supporting surface on which the frame is to be mounted, said hanger comprising a first connecting portion projecting in a predetermined direction and formed of thin sheet material having a predetermined thickness and arranged in a first plane and a second connecting portion projecting in a direction opposite to said predetermined direction and the second connecting portion offset from said first connecting portion in said transverse direction and arranged in a second plane substantially parallel to said first plane and connected to said first connecting portion by a bridging portion, said first and second planes being spaced a distance less than said predetermined depth of said rails between said front and rear surfaces, said first connecting portion including first means for attaching the hanger to a rail rear surface, said second connecting portion being offset by said bridging portion to position said second connecting portion internally of a space formed by the rails of the frame between said front and rear surfaces and offset or spaced from the wall or supporting surface in a normal hanging position of the frame, said second connecting portion including second means for cooperating with a fastener on the wall or supporting surface, whereby the frame can be supported on a wall or supporting surface while being spaced from the wall or supporting surface substantially by said predetermined thickness of said first connecting portion, wherein said second connecting portion includes a substantially closed ring.

14. A hanger as defined in claim 13, wherein said ring is pivotably secured to said bridging portion.

15. A hanger as defined in claim 13, wherein a pair of hangers are provided with each of the hangers being attachable to another one of the spaced lateral rails.

16. A hanger as defined in claim 15, wherein said hangers each have a ring pivotably secured to said bridging portion.

17. A hanger as defined in claim 15, wherein said first and second connecting portions and said bridging portions are formed from a thin sheet of material folded over itself to form a hinge member substantially within said second plane for pivotably retaining an associated ring.

18. A hanger as defined in claim 13, wherein said ring is substantially oblong.

19. A hanger as defined in claim 13, wherein said ring is substantially rectangular.

* * * * *